US008325095B2

(12) United States Patent
Nishikido et al.

(10) Patent No.: US 8,325,095 B2
(45) Date of Patent: Dec. 4, 2012

(54) ANTENNA ELEMENT AND PORTABLE RADIO

(75) Inventors: Tomoaki Nishikido, Sendai (JP); Hironori Kikuchi, Sendai (JP); Yoshio Koyanagi, Yokohama (JP); Kenichi Sato, Sendai (JP); Hiroaki Ohmori, Sendai (JP)

(73) Assignee: Panasonic Corporation, Osaka (JP)

( * ) Notice: Subject to any disclaimer, the term of this patent is extended or adjusted under 35 U.S.C. 154(b) by 364 days.

(21) Appl. No.: 12/672,391

(22) PCT Filed: Aug. 10, 2007

(86) PCT No.: PCT/JP2007/065751

§ 371 (c)(1),
(2), (4) Date: Feb. 5, 2010

(87) PCT Pub. No.: WO2009/022389

PCT Pub. Date: Feb. 19, 2009

(65) Prior Publication Data

US 2011/0128191 A1 Jun. 2, 2011

(51) Int. Cl.
*H01Q 1/24* (2006.01)
*H01Q 1/38* (2006.01)

(52) U.S. Cl. ..... 343/702; 343/700 MS; 343/846

(58) Field of Classification Search ..... 343/702, 343/700 MS, 846

See application file for complete search history.

(56) References Cited

U.S. PATENT DOCUMENTS

| | | | | |
|---|---|---|---|---|
| 7,250,911 | B2 * | 7/2007 | Lindell | 343/702 |
| 7,453,405 | B2 * | 11/2008 | Nishikido et al. | 343/702 |
| 7,508,348 | B2 * | 3/2009 | Abdul-Gaffoor et al. | 343/702 |
| 2002/0075192 | A1 | 6/2002 | Iwai | |
| 2006/0214856 | A1 | 9/2006 | Nakano | |

FOREIGN PATENT DOCUMENTS

JP 08-084013 A 3/1996

(Continued)

OTHER PUBLICATIONS

International Search Report mailed Sep. 25, 2007, in corresponding International Application No. PCT/JP2007/065751.

(Continued)

*Primary Examiner* — Hoang V Nguyen
(74) *Attorney, Agent, or Firm* — Seed IP Law Group PLLC

(57) ABSTRACT

There is provided an antenna element capable of implementing miniaturization, acquisition of a high gain, and broadening of a band and coping with multiple bands. The antenna element includes a first antenna element 5 having shape of a box (a rectangular-parallelepiped shape) in which a first conductor plate 51, a second conductor plate 52, and a third conductor plate 53 are arranged so as to define at least three surfaces of a substantial rectangular parallelepiped and in which electric power is fed from a substantial corner of a lower circuit board (a ground plate) 21 to the first conductor plate 51; and a second antenna element 6 having shape of a box (a rectangular-parallelepiped shape) in which a fourth conductor plate 61, a fifth conductor plate 62, and a sixth conductor plate 63 are arranged so as to define at least three surfaces of a substantial rectangular parallelepiped, the fourth conductor plate 61 being connected by way of a resonance circuit 7 to the first antenna element 5 at a portion thereof apart from a feeding point of the first antenna element 5.

5 Claims, 6 Drawing Sheets

FOREIGN PATENT DOCUMENTS

| | | | |
|---|---|---|---|
| JP | 2002-223114 | A | 8/2002 |
| JP | 2005-045646 | A | 2/2005 |
| JP | 2005-086418 | A | 3/2005 |
| JP | 2006-279159 | A | 10/2006 |
| JP | 2007-036338 | A | 2/2007 |
| WO | 2006/125925 | | 11/2006 |

OTHER PUBLICATIONS

Wong et al., "Wideband Internal Folded Planar Monopole Antenna for UMTS/WiMAX Folder-Type Mobile Phone," *Microwave and Optical Technology Letters*, 48 (2): 324-327, 2006.

* cited by examiner

VSWR CHARACTERISTIC

VSWR CHARACTERISTIC

VSWR CHARACTERISTIC

ANTENNA ELEMENT AND PORTABLE RADIO

TECHNICAL FIELD

The present invention relates to an antenna element and a portable radio equipped with the antenna element.

BACKGROUND ART

In relation to a portable radio equipped with such an antenna (e.g., a cellular phone), there is recently a growing demand for addition of functions of a plurality of radio systems; for instance, a GPS and Bluetooth (Registered Trademark). When an attempt is made to provide a cellular phone with a plurality of radio systems, a range of working frequency band becomes broader. For instance, the portable radio must be made compatible with an 800 MHz band, a 1.7 GHz band, and a 2 GHz band for communication of a cellular phone. Specifically, the portable radio must be made compatible with a 1.5 GHz band for GPS and 2.4 GHz band for Bluetooth. Accordingly, when an attempt is made to equip the cellular phone with such plural radio systems, a built-in antenna must ensure predetermined antenna performance for a plurality of frequency bands.

A rectangular-parallelepiped-shaped antenna element 200 has hitherto been proposed as shown in FIG. 7 (see; for instance, Patent Document 1). In the antenna 200, a rectangular-parallelepiped-shaped antenna element 201 whose minimum side is smaller than $\lambda/8$ ($\lambda$: a wavelength) is connected to a coaxial cable 202 and disposed in close proximity to a ground plate 202. It is shown that use of the rectangular-parallelepiped-shaped antenna element 202 makes a bandwidth broader.

An antenna element described in connection with Patent Document 2 shown in FIG. 8 has already been known as such a rectangular-parallelepiped-shaped antenna element. In an antenna element 300 described in connection with; for instance, Patent Document 2, a conductor plate 301 is connected to a conductor ground plate 303 by way of a metal wire 302 as shown in (A) of FIG. 8, and power is fed from a feeding point 305 by way of a metal wire 304. Meanwhile, a conductor wall 306 is electrically connected at the other end to an electromagnetic coupling adjustment plate 307, as well as being electrically connected at one end to the conductor plate 301. The electromagnetic coupling adjustment plate 307 is disposed while spaced at a predetermined gap away from the conductor ground plate 303 as shown in (B) of FIG. 8, thereby forming a capacitor between the conductor ground plate 303 and the electromagnetic coupling adjustment plate 307.

Incidentally, the antenna element 300 makes a frequency low by arranging the conductor wall 306 and the electromagnetic coupling adjustment plate 307; for instance, in such a way that a path from a shortcircuit area where the metal wire 302 is connected to the conductor plate 301 to an open end of the electromagnetic coupling adjustment plate 307 becomes longer. In particular, an arrangement is made in such a way that a current path from a feeding point where the metal wire 304 is connected to the conductor plate 301 to the shortcircuit area comes to a half wavelength of a desired resonance frequency, whereby both a reduced resonance frequency of an antenna and a broader band of a frequency characteristic are accomplished.

Patent Document 1: JP-A-2006-279159
Patent Document 2: JP-A-2002-223114

DISCLOSURE OF THE INVENTION

Problems that the Invention is to Solve

Even a compact antenna, such as that described in connection with Patent Document 2; however, requires an increase in the size of an antenna element in order to cover a lower frequency band. Further, the antenna element is a plate-like inversed-F antenna, and a ground plate is required to be placed beneath the element. In order to achieve a broader band, a required distance between the element and the base plate is of the order of 7 mm, and the antenna element is unsuitable for use in slim equipment, such as a portable radio.

On the contrary, as described in connection with Patent Document 1, when one half of the antenna element 202 is surrounded by the proximal ground plate 202, the band tends to become narrower as compared with a case where no ground plate is provided, and radiation efficiency also tends to become worse.

The present invention has been conceived in light of the circumstance and aims at providing an antenna element and a portable radio that enable miniaturization, achievement of a high gain, and broadening of a band and that also can cope with multiple bands.

Means for Solving the Problems

An antenna element according to the present invention includes: a first antenna element in which at least three surfaces of a substantial rectangular parallelepiped are defined by: a substantially rectangular first conductor plate arranged at a predetermined space apart from a ground plate; a substantially rectangular second conductor plate sharing one widthwise side of the first conductor plate and arranged at an angle of about 90° with respect to the first conductor plate; and a substantially rectangular third conductor plate sharing another widthwise side of the second conductor plate opposing the widthwise side shared by the first conductor plate and the second conductor plate, and arranged at an angle of about 90° with respect to the second conductor plate, and in which electric power is fed from a substantial corner of the ground plate to the first conductor plate; and a second antenna element in which at least three surfaces of a substantial rectangular parallelepiped are defined by: a substantially rectangular fourth conductor plate connected by way of a resonance circuit to the first antenna element at a portion thereof apart from a feeding point of the first antenna element; a substantially rectangular fifth conductor plate sharing one side of the fourth conductor plate and arranged at an angle of about 90° with respect to the fourth conductor plate; and a substantially rectangular sixth conductor plate sharing another side of the fifth conductor plate opposing the side of the fifth conductor plate shared by the fourth conductor plate, and arranged at an angle of about 90° with respect to the fourth conductor plate.

Further, an antenna element according to the present invention includes: a first antenna element in which at least three surfaces of a substantial rectangular parallelepiped are defined by: a substantially rectangular first conductor plate arranged at a predetermined space apart from a ground plate; a substantially rectangular second conductor plate sharing one widthwise side of the first conductor plate and arranged at an angle of about 90° with respect to the first conductor plate; and a substantially rectangular third conductor plate sharing another widthwise side of the second conductor plate opposing the widthwise side shared by the first conductor plate and the second conductor plate, and arranged at an angle of about 90° with respect to the second conductor plate, and in which electric power is fed from a substantial corner of the ground plate to the first conductor plate; and a third antenna element including a seventh conductor plate that is connected to a neighborhood of the feeding point of the first antenna element and that has the largest side whose size is about λ/4 of a specific frequency.

A portable radio according to the present invention is a portable radio including a first housing for accommodating a ground plate of the portable radio, a second housing equipped with an antenna element, and a hinge which connects the first housing to the second housing and which holds the second housing rotatably with respect to the first housing, wherein the antenna element provided in the second housing comprises: a first antenna element having a shape in which the first conductor plate, the second conductor plate, and the third conductor plate are arranged so as to define at least three surfaces of a substantial rectangular parallelepiped, wherein electric power is fed from a substantial corner of the ground plate to the first conductor plate placed in proximity to the hinge; and a second antenna element having a shape in which a fourth conductor plate, a fifth conductor plate, and a sixth conductor plate are arranged so as to define at least three surfaces of a substantial rectangular parallelepiped, the fourth conductor plate being connected by way of a resonance circuit to the first antenna element at a portion thereof apart from a feeding point of the first antenna element.

A portable radio according to the present invention is a portable radio including a first housing for accommodating a ground plate of the portable radio, a second housing equipped with an antenna element, and a hinge which connects the first housing to the second housing and which holds the second housing rotatably with respect to the first housing, the portable radio comprising: a first antenna element having a shape in which the first conductor plate, the second conductor plate, and the third conductor plate are arranged so as to define at least three surfaces of a substantial rectangular parallelepiped, in which electric power is fed from a substantial corner of the ground plate to the first conductor plate; and a third antenna element including a seventh conductor plate that is connected to a neighborhood of the feeding point of the first antenna element and that has the largest side whose size is about λ/4 of a specific frequency.

Advantages of the Invention

An antenna element according to the present invention includes a first antenna having a shape in which a first conductor plate, a second conductor plate, and a third conductor plate are arranged so as to define at least three surfaces of a substantial rectangular parallelepiped, in which electric power is fed from a substantial corner of a ground plate to the first conductor plate; and a second antenna element in which a fourth conductor plate, a fifth conductor plate, and a sixth conductor plate, the fourth conductor plate being connected by way of a resonance circuit to the first antenna element at a portion thereof apart from a feeding point of the first antenna element. A box-shaped antenna, which is a multiband antenna including board-shaped conductors, is connected by way of a resonance circuit to board-shaped conductors configuring a similar box adaptable to a desired frequency band, whereby a compact, high-gain multiband antenna can be provided.

An antenna element according to the present invention includes a first antenna having a shape in which a first conductor plate, a second conductor plate, and a third conductor plate are arranged so as to define at least three surface of a substantial rectangular parallelepiped, in which electric power is fed from a substantial corner of a ground plate to the first conductor plate; and a third antenna element including a seventh conductor plate that is connected to a neighborhood of the feeding point of the first antenna element and that has the largest side whose size is about λ/4 of a specific frequency. Thus, a compact, high-gain multiband antenna can be provided.

A portable radio according to the present invention includes a first housing for accommodating a ground plate of the portable radio, a second housing equipped with an antenna element, and a hinge which connects the first housing to the second housing and which holds the second housing rotatably with respect to the first housing. The antenna element provided in the second housing includes a first antenna element having a shape in which the first conductor plate, the second conductor plate, and the third conductor plate are arranged so as to define at least three surfaces of a substantial rectangular parallelepiped, wherein electric power is fed from a substantial corner of the ground plate to the first conductor plate placed in proximity to the hinge; and a second antenna element having a shape in which a fourth conductor plate, a fifth conductor plate, and a sixth conductor plate are arranged so as to define at least three surfaces of a substantial rectangular parallelepiped, the fourth conductor plate being connected by way of a resonance circuit to the first antenna element at a portion thereof apart from a feeding point of the first antenna element. A box-shaped antenna, which is a multiband antenna including board-shaped conductors, is connected by way of a resonance circuit to board-shaped conductors configuring a similar box adaptable to a desired frequency band, whereby a portable radio having a compact, high-gain multiband antenna can be provided.

A portable radio according to the present invention includes a first housing for accommodating a ground plate of the portable radio, a second housing equipped with an antenna element, and a hinge which connects the first housing to the second housing and which holds the second housing rotatably with respect to the first housing. The portable radio includes a first antenna element having a shape in which the first conductor plate, the second conductor plate, and the third conductor plate are arranged so as to define at least three surfaces of a substantial rectangular parallelepiped, in which electric power is fed from a substantial corner of the ground plate to the first conductor plate; and a third antenna element including a seventh conductor plate that is connected to a neighborhood of the feeding point of the first antenna element and that has the largest side whose size is about λ/4 of a specific frequency. Thus, it is possible to provide a portable radio having a compact, high-gain multiband antenna.

DESCRIPTIONS OF THE REFERENCE NUMERALS AND SYMBOLS

10, 20 PORTABLE RADIO
2 LOWER HOUSING (FIRST HOUSING)
21 LOWER CIRCUIT BOARD (GROUND PLATE)
22 FIRST RADIO CIRCUIT
23 SECOND RADIO CIRCUIT
24 THIRD RADIO CIRCUIT
25 FOURTH RADIO CIRCUIT
26 FIFTH RADIO CIRCUIT
27 DUPLEXER
28 MATCHING CIRCUIT
3 UPPER HOUSING (SECOND HOUSING)
31 UPPER CIRCUIT BOARD

4 HINGE
5 FIRST ANTENNA ELEMENT
51 FIRST CONDUCTOR PLATE
52 SECOND CONDUCTOR PLATE
53 THIRD CONDUCTOR PLATE
54 FEEDING CONDUCTOR
6 SECOND ANTENNA ELEMENT
61 FOURTH CONDUCTOR PLATE
62 FIFTH CONDUCTOR PLATE
63 SIXTH CONDUCTOR PLATE
7 RESONANCE CIRCUIT (PARALLEL RESONANCE CIRCUIT)
8 THIRD ANTENNA ELEMENT
81 SEVENTH CONDUCTOR PLATE
82 FIRST CONNECTION CONDUCTOR PLATE
83 SECOND CONNECTION CONDUCTOR PLATE

BEST MODES FOR IMPLEMENTING THE INVENTION

Embodiments of the present invention are hereinbelow described in detail by reference to the accompanying drawings.

First Embodiment

Figure 1:
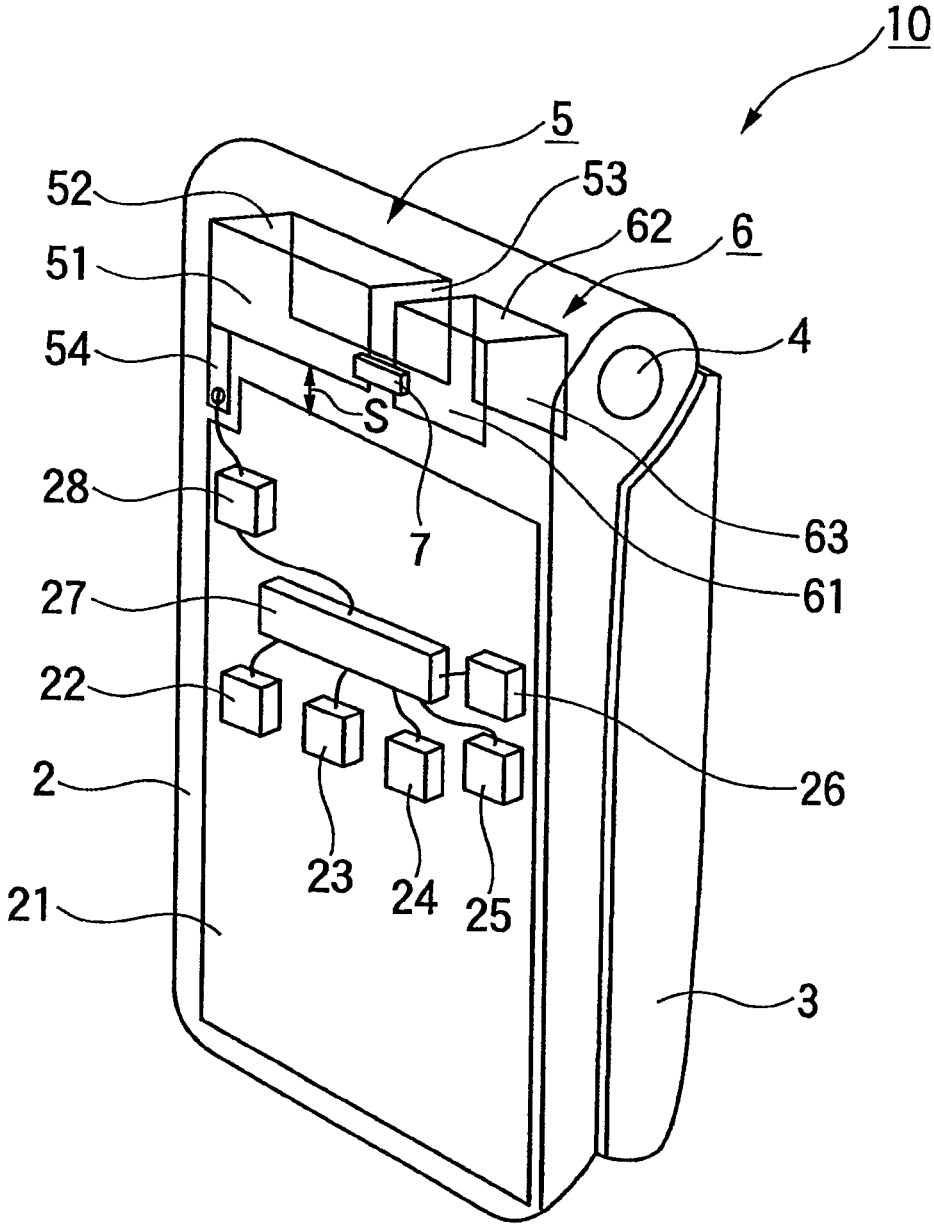
FIG. 1 is a perspective view showing a portable radio of a first embodiment of the present invention in a closed state.
Figure 2:
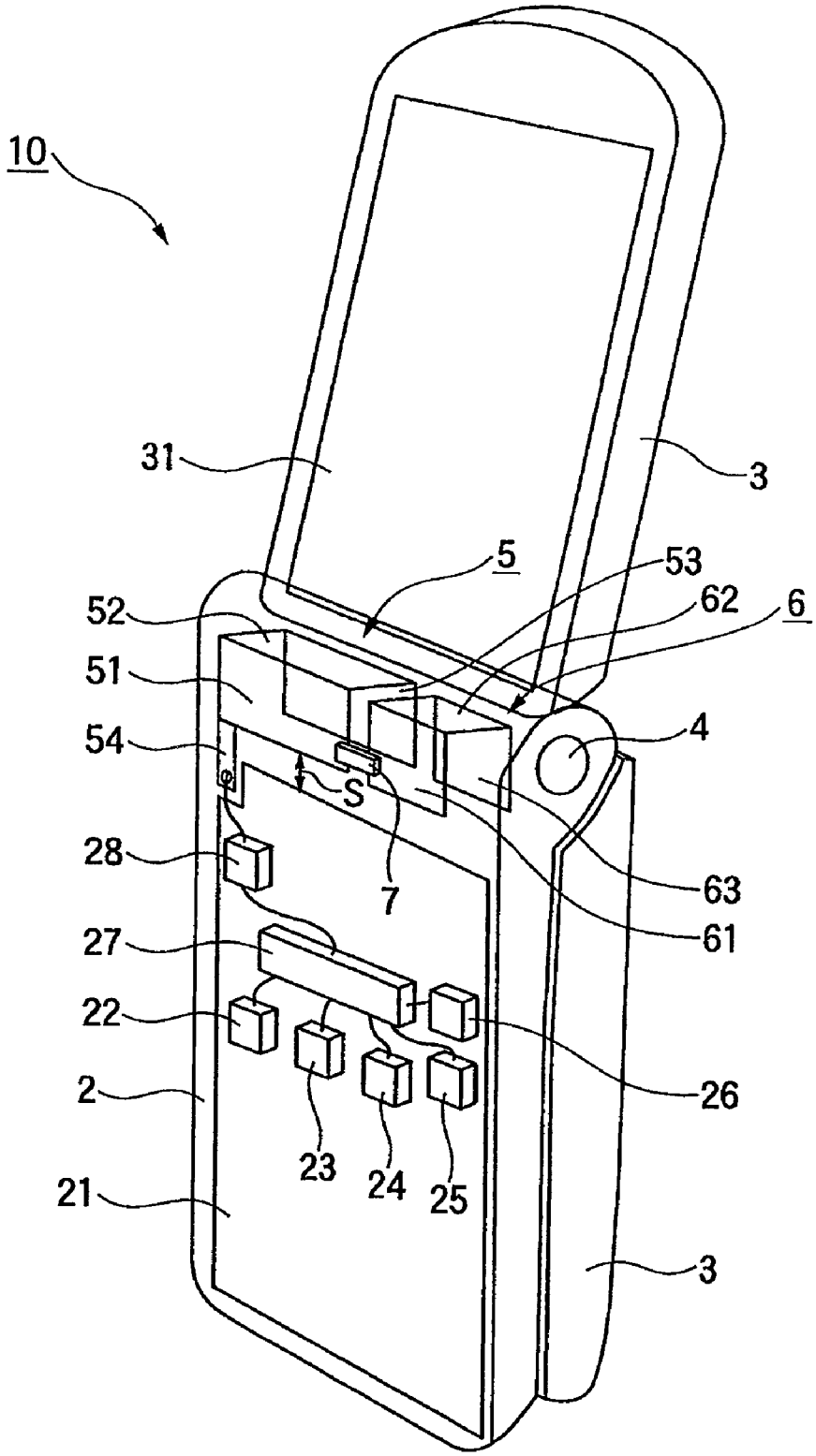
FIG. 2 is a perspective view showing the portable radio of the first embodiment in an open state.

FIGS. 1 and 2 show a folding portable radio 10 of a first embodiment of the present invention. The portable radio 10 has a lower housing 2 that is a first housing; an upper housing 3 that is a second housing; a hinge 4 that joins the lower housing 2 to the upper housing 3 rotatably; a first antenna element 5 and a second antenna element 6 making up a monopole antenna; and a resonance circuit 7.

The lower housing 2 houses a lower circuit board 21 making up a ground plate (a ground) of the portable radio 10 and is configured so as to feed electric power from a corner (a portion on the left-upper corner in FIG. 1) of the lower circuit board 21 of the ground plate to the first antenna element 5 and the second antenna element 6. The lower housing 2 of the embodiment is made of a resin frame.

A first radio circuit 22, a second radio circuit 23, a third radio circuit 24, a fourth radio circuit 25, a fifth radio circuit 26, a duplexer 27, and a matching circuit 28 are mounted on the lower circuit board 21 and is made so as to measure; for instance, 45 mm×85 mm in the embodiment.

The first radio circuit 22 through the fifth radio circuit 26 of the embodiment are compatible with a 800 MHz frequency band, a 1.5 GHz frequency band, a 1.7 GHz frequency band, a 2 GHz frequency band, and a 2.4 GHz frequency band, respectively.

The duplexer 27 is for sharing an antenna among a plurality of radio frequency bands. In the present embodiment, the duplexer 26 is equipped with; for instance, bandpass filters conforming to respective frequency bands.

The matching circuit 28 performs a function of seeking matching between the first antenna element 5 and the second antenna element 6, and circuit impedance (of generally 50Ω).

The upper housing 3 contains the upper circuit board 31. When the upper and lower housings are opened, the upper circuit board 31 and the antenna element 5 are capacitively coupled, to thus act as a housing antenna (operate as a synthetic antenna). The upper housing 3 of the present embodiment is also made of a resin frame, as is the lower housing 2. In the present embodiment, the upper circuit board 31 is made so as to measure; for instance, 45 mm×75 mm.

The first antenna element 5 is disposed in the vicinity of a hinge 4. The first antenna element 5 has a first conductor plate 51, a second conductor plate 52, a third conductor plate 53, and a feeding conductor 54 and is configured as described above, so as to feed electric power from a corner of the lower circuit board 21 of the ground plate to the first conductor plate 51 by way of the feeding conductor 54. In particular, in relation to feeding of electric power to the embodiment, electric power is fed from a substantial corner of the lower circuit board 21 to a substantial corner of the first conductor plate 51 by way of the feeding conductor 54. Each of the conductor plates 51 to 53 of the embodiment has a thickness of; for instance, 0.1 mm. In relation to specific sizes of the first to third conductor plates 51 to 53 of the embodiment, the first conductor plate 51 has a size of; for instance, 22×6 mm; the second conductor plate 52 has a size of; for instance, 22×5 mm; and the third conductor plate 53 has a size of; for instance, 22×6 mm.

In the present embodiment, the antenna element 5 is fastened by means of; for instance, an insulating holder having a low dielectric constant.

The first conductor plate 51 is made up of a substantially rectangular substance disposed in the vicinity of the hinge 4 while arranged at a predetermined interval apart from the ground plate; and is connected to the matching circuit 28 on the ground plate by way of the feeding conductor 54. The first conductor plate 51 and the second conductor plate 52 share a long side, specifically the second conductor plate 52 is arranged while bent at an angle of about 90° with respect to the first conductor plate.

The first conductor plate 51 is a thin conductor having a substantially rectangular shape and connected to the duplexer 27 by way of the matching circuit 28. The duplexer 27 is connected respectively to the first radio circuit 22 to the fifth radio circuit 26 that are the radio sections of respective communications systems.

Likewise, the second conductor plate 52 is a thin conductor having a substantially rectangular shape and is made up as described above, of a substantially rectangular substance that shares a widthwise side (a long side) of the first conductor plate 51 and that is bent to an angle of about 90° with respect to (a direction of plane of) the first conductor plate 51. The second conductor plate 52 and the third conductor plate 53 share their widthwise one side (long side). The second conductor plate 52 is disposed while bent to an angle of about 90° with respect to the third conductor plate 53. Thus, the first conductor plate 51 and the third conductor plate 53 oppose each other.

The third conductor plate 53 is likewise a thin conductor having a substantially rectangular shape and shares one of two widthwise sides (long sides) of the second conductor plate 52 that is not shared by the first conductor plate 51. The third conductor plate 53 is made up of a substantially rectangular substance that is disposed while bent to an angle of about 90° with respect to the second conductor plate 52 so as to face the first conductor plate 51. In the present embodiment, an interval S between the first conductor plate 51, the third conductor plate 53 and the lower circuit substrate 21 is of the order of 5 mm.

The second antenna element 6 has the same box shape (or is a box-shaped element) as that of the first antenna element 5. The second antenna element 6 includes a fourth conductor plate 61, a fifth conductor plate 62, and a sixth conductor plate 63; and is connected to the first antenna element 5 by way of the resonance circuit 7. In order to be able to cope with a desired frequency (800 MHz) in a pinpoint manner, the second antenna element 6 of the present embodiment is additionally connected to the first antenna element 5 by way of the resonance circuit 7.

In the present embodiment, the antenna element 6 is fastened by means of; for instance, an insulating holder having a low dielectric constant.

The fourth conductor plate 61 is a substantially rectangular, thin conductor and connected to an end of the first conductor plate 51 opposite to the end thereof connected to the feeding conductor 54 (a feeding section) by way of the resonance circuit 7.

The fifth conductor plate 62 is a substantially rectangular, thin conductor; shares one long side with the fourth conductor plate 61; and is arranged while bent to an angle of about 90° with respect to the fourth conductor plate 61.

The sixth conductor plate 63 is a substantially rectangular, thin conductor; shares another side (long side), which is not shared by the fourth conductor plate 61, among two long sides of the fifth conductor plate 62; and is arranged while bent to an angle of about 90° with respect to the fifth conductor plate 62 so as to oppose the fourth conductor plate 61.

The resonance circuit 7 includes a parallel resonance circuit. In particular, the resonance circuit is a parallel resonance circuit that causes resonance at a lower limit frequency of a frequency band covered by the first antenna element. Thus, high impedance is achieved at a high frequency band covered by the first antenna element, whereby the resonance circuit 7 is in an open state. That is, the resonance circuit 7 connected to the first conductor plate 51 becomes not connected to the fourth conductor plate 61 at the frequency band covered by the first antenna element. Further, the resonance circuit 7 connected to the first conductor plate 51 becomes connected to the fourth conductor plate 61 at a low frequency band where an antenna element implemented by adding the second antenna element to the first antenna element causes resonance. In relation to constants of the parallel resonance circuit, for instance, L (inductance) is set to 18 nH, and C (capacitance) is set to 0.65 pF. Since a resonance frequency comes to about 1.47 GHz, the fourth conductor plate 61 performs operation similar to that performed when the fourth conductor plate is not connected, in a radio-frequency manner, to the first conductor plate 51 at a frequency band that is higher than 1.47 GHz.

Figure 3:
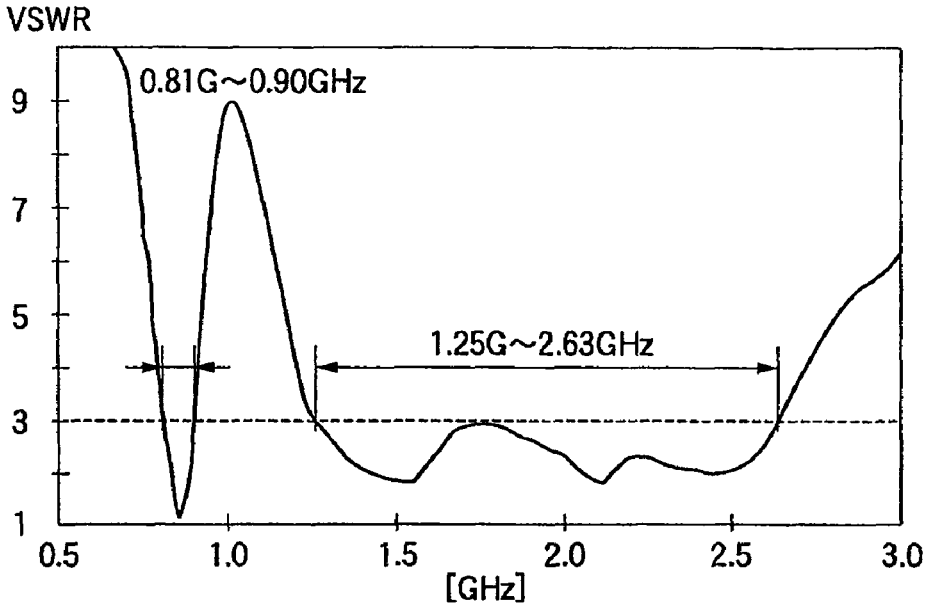
FIG. 3 is a graph showing a VSWR characteristic achieved when the portable radio of the first embodiment is in the closed state.

In the embodiment including such a configuration, when the housings are closed, a bandwidth of VSWR≦3 at which a superior antenna characteristic is achieved is 90 MHz (0.81 GHz to 0.90 GHz) at an 800 MHz band as shown in FIG. 3. A band width achieved at a high frequency band is 1.38 GHz (1.25 GHz to 2.63 GHz).

On the contrary, when the housings are opened, the antenna elements of the present embodiment perform operation such as that will be described below. In FIG. 2, the upper circuit board 31 of the upper housing 3 and the first conductor plate 51 (or the second conductor plate 52 or the third conductor plate 53) are capacitively coupled, and the upper circuit board 31 and the fourth conductor plate 61 (or the fifth conductor plate 62 or the sixth conductor plate 63) are capacitively coupled. The upper circuit board 31 is thereby excited, and the upper circuit board 31 operates as an antenna (a first antenna).

Figure 4:
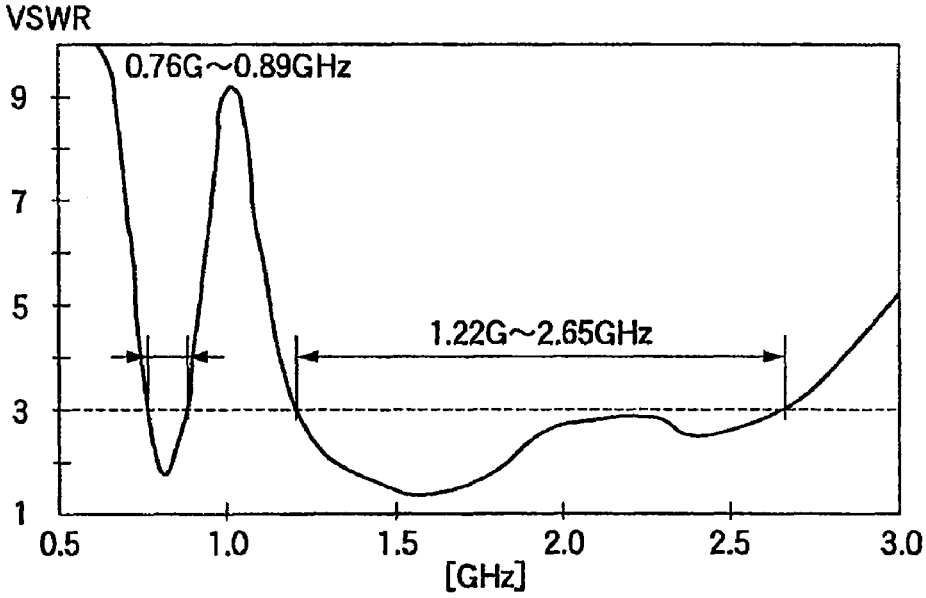
FIG. 4 is a graph showing a VSWR characteristic achieved when the portable radio of the first embodiment is in the open state.

For these reasons, when compared with the case where the housings are closed, the volume of the antenna becomes larger, and hence a band becomes broader. When compared with the state in which the housings are closed, a high antenna gain is consequently acquired, in particular, at a low frequency band. The bandwidth of VSWR≦3 is 130 MHz (0.76 GHz to 0.89 GHz) at an 800 MHz band as shown in FIG. 4. A band width achieved at a high frequency band is 1.43 GHz (1.22 GHz to 2.65 GHz).

Accordingly, in the present embodiment, electric power is fed from the corner (an upper left corner in FIG. 1) of the lower circuit board 21 that is a ground plate to the corner (a lower left corner in FIG. 1) of the first conductor plate 51 that is a board-shaped element, whereby an antenna despite its small size can realize broadband characteristic in a low frequency band.

Further, according to the present embodiment, the first antenna element and the second antenna element 6 that define the box-shaped antenna are placed in the vicinity of the hinge 4 of the portable radio 1 having a collapsing (twofold) structure. The portable radio can thereby be further miniaturized, and a high communication gain and frequency bands for a plurality of communications systems can be acquired.

Moreover, it also becomes possible to cover an 800 MHz band by addition of the second antenna element 6 that copes with a desired frequency (800 MHz) in a pinpoint manner, by way of the resonance circuit 7.

Second Embodiment

A second embodiment of the present invention is now described by reference to FIGS. 5 and 6. Elements of the present embodiment that are the same as those of the first embodiment are assigned the same reference numerals, and their repeated explanations are omitted.

Figure 5:
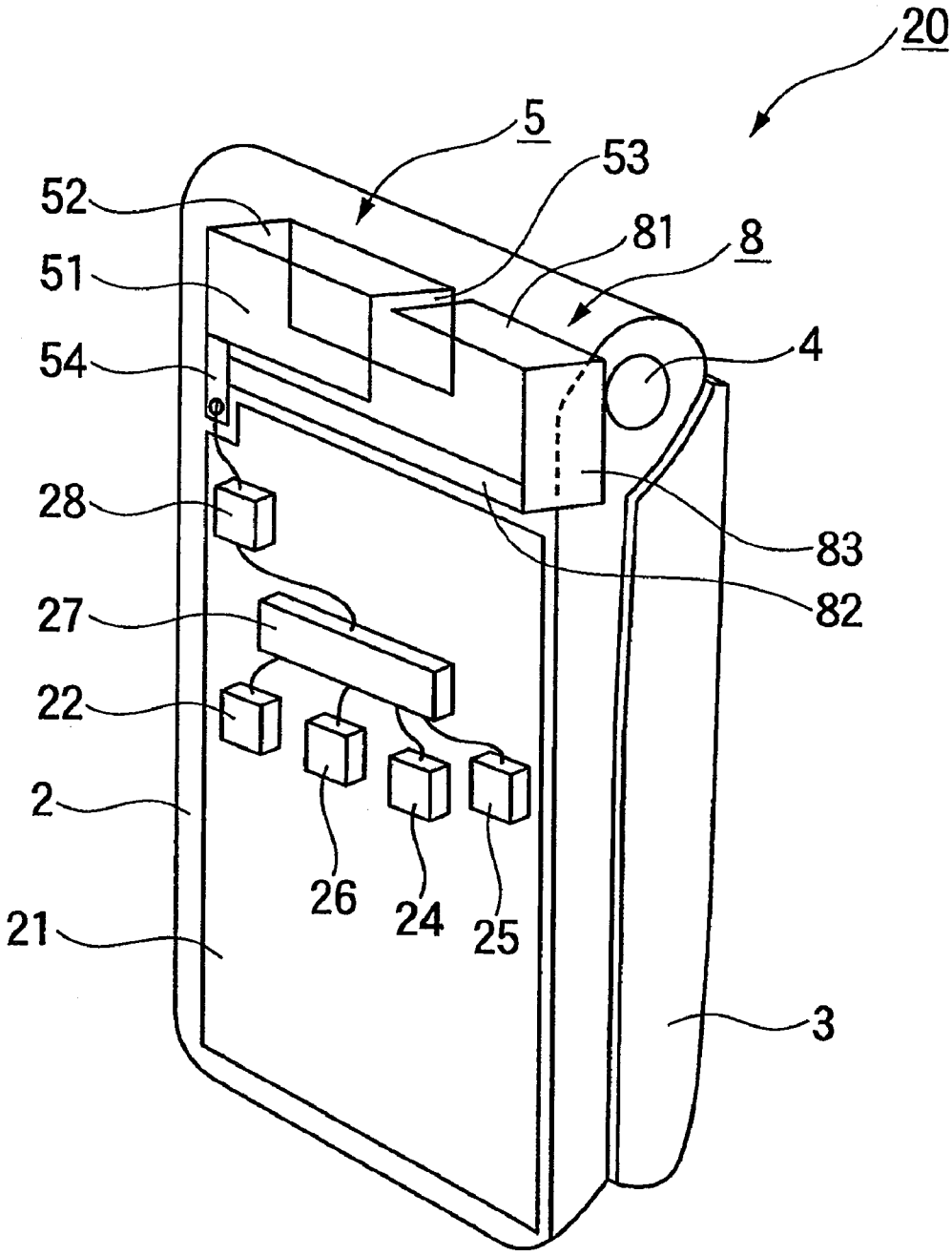
FIG. 5 is a perspective view showing a portable radio of a second embodiment in a closed state.

FIG. 5 shows a portable radio 20 of the present embodiment. The portable radio 20 differs from the portable radio 10 of the first embodiment in that the portable radio 20 has the third antenna element 8 in place of the second antenna element 6 and that a resonance circuit is unnecessary and hence not provided. In the portable radio 20 of the present embodiment, a covered frequency band in the high frequency band shown in FIG. 6 is changed, and hence the second radio circuit 23 is not provided.

The third antenna element 8 includes a seventh conductor plate 81; is a substantially rectangular, thin conductor like the other conductor plates; and is connected to the feeding conductor 54 by way of a first connection conductor plate 82 and a second connection conductor plate 83.

In the present embodiment, the antenna element 8 is fastened by means of; for instance, an insulating holder having a low dielectric constant.

The first connection conductor plate 82 is connected to the feeding conductor 54 connected to the corner (the lower left corner shown in FIG. 1) of the first conductor plate 51.

In FIG. 5, the second connection conductor plate 83 shares one of two short sides of the first connection conductor plate 82 and a part of one of two long right and left sides of the first connection conductor plate 82. Further, the second connection conductor plate is arranged while bent to an angle of 90° with respect to the short side of the first connection conductor plate 82. One (an upper short side) of a pair consisting of upper and lower short sides of the second connection conductor plate 83 is common to the short side of the seventh conductor plate 81 in the drawing. The seventh conductor plate 81 is arranged while bent to an angle of 90° with respect to the short side. The seventh conductor plate 81 of the embodiment has an element length of about 75 mm that is equivalent to an about λ/4 length of a desired frequency band.

Figure 6:
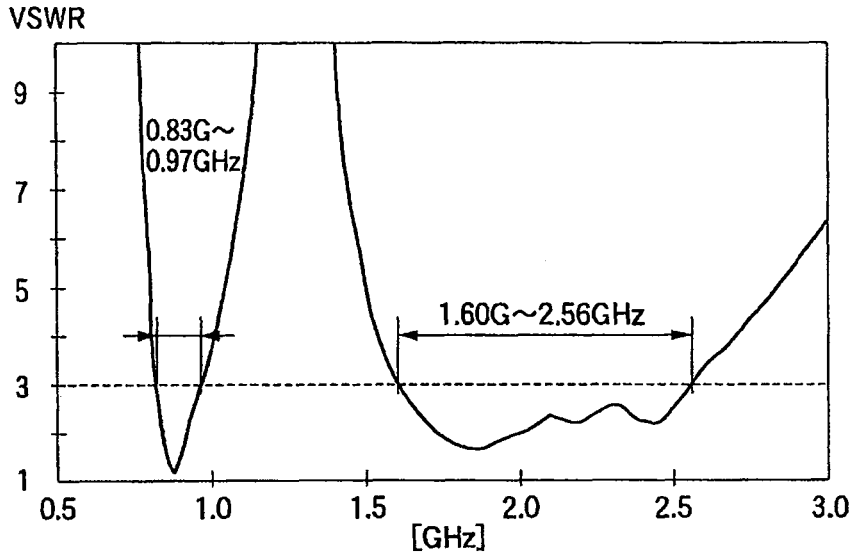
FIG. 6 is a graph showing a VSWR characteristic achieved when the portable radio of the second embodiment is in the closed state.
Figure 7:
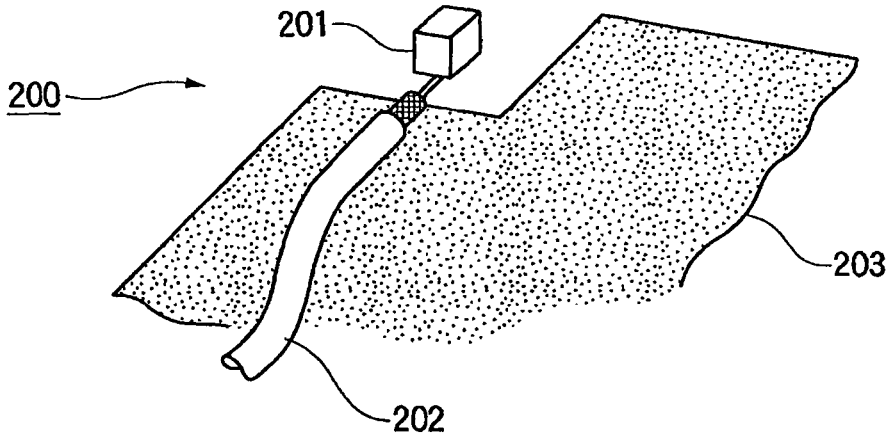
FIG. 7 is a perspective view of a principal feature showing another relate-art antenna element.
Figure 8:
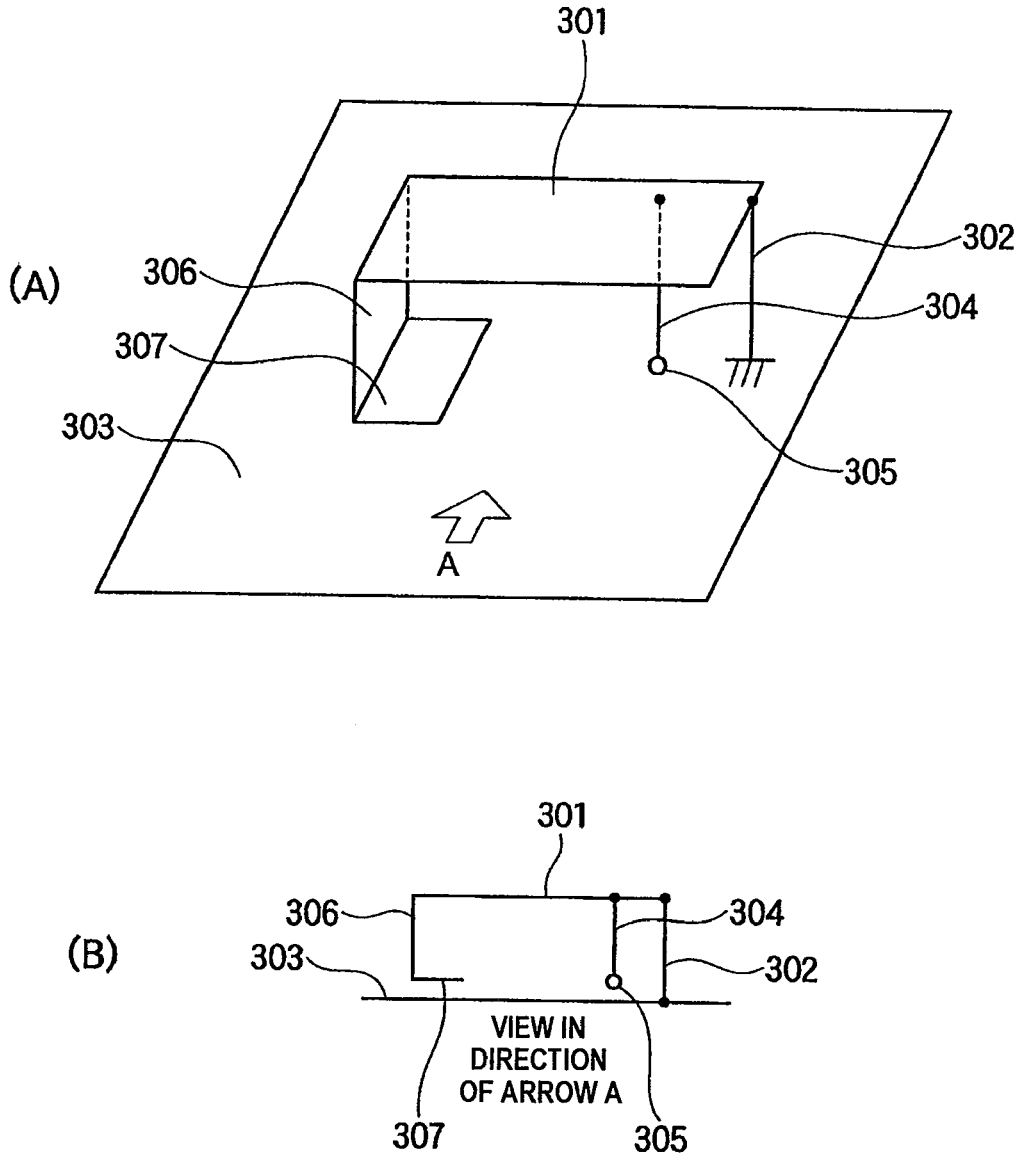
In FIG. 8, (A) is a perspective view showing a still another related-art antenna element, and (B) is a side view of the antenna element.

FIG. 6 is a graph showing a VSWR characteristic achieved when the housings are closed. The range of frequency that can satisfy VSWR≦3 is defined as a band width (a working frequency band) of the present invention even in FIG. 6.

According to the graph shown in FIG. 6, the bandwidth of VSWR≦3 is 140 MHz (0.83 GHz to 0.97 GHz) at the 800 MHz band when the housings are closed. A bandwidth in a high frequency band is 960 MHz (1.60 GHz to 2.56 GHz).

Therefore, according to the present embodiment, the band width of the antenna element of the first embodiment is 0.09 GHz at the 800 MHz band achieved when the housings are closed. On the contrary, the bandwidth of the antenna element 6 of the present embodiment is 0.14 GHz. Accordingly, in the present embodiment, the bandwidth is enlarged by 1.5 times as compared with the bandwidth achieved by the antenna element 5 of the first embodiment. An attempt can be made to broaden the 800 MHz band that is a low frequency band.

The present invention is not limited to the foregoing embodiments at all and practicable in various forms without departing the scope of gist of the invention.

Specifically, in the first embodiment, the first conductor plate 51 and the fourth conductor plate 61 are connected together by way of the resonance circuit 7; however, the second conductor plate 52 and the fifth conductor plate 62 (or the third conductor plate 53 and the sixth conductor plate 63) may also be connected together by way of the resonance circuit 7.

In the first embodiment, the second antenna element 6 added to the first antenna element 5 includes the fourth conductor plate 61 to the sixth conductor plate 63. The number of conductor plates (board-shaped conductors) may be three or less or more, so long as an area of the conductor plate (the board-shaped conductor) that enables coverage of a desired frequency band can be assured. The same also applies to the second embodiment. The third antenna element 6 includes the first connection conductor plate 82 and the second connection conductor plate 83. The number of conductor plates (board-shaped conductors) may also be two or less or more, so long as the area of the conductor plate (the board-shaped conductor) that can cover a desired frequency band can be assured.

In the first and second embodiments, the antenna element 5, the antenna element 6, and the antenna element 8 are configured so as to be fastened by means of; for instance, insulating holders having a low dielectric constant. However, the present invention is not limited particularly to such a configuration.

In addition to being provided in a folding portable radio, such as that mentioned in connection with the first and second embodiments, the antenna element of the present invention can also be placed on an upper end of a straight-type or slide-type portable radio. In the case of a slide-type portable radio, an advantage that is substantially the same as that yielded in a closed state is yielded. A conductor element making up the antenna element may also be a flexible substrate in place of a board-shaped conductor plate.

The present invention has been described in detail by reference to the specific embodiment. It is, however, manifest to those skilled in the art that the present invention is susceptible to various alterations or modifications without departing from the spirit and scope of the present invention.

Industrial Applicability

As mentioned above, according to the present invention, a box-shaped antenna, which is a multiband antenna including board-shaped conductor plates, is connected, by way of a resonance circuit, to board-shaped conductor plates configuring a similar box adaptable to a desired frequency band, whereby a compact, high-gain multiband antenna can be materialized. The antenna element hence lends itself to use for a plurality of radio systems to which functions; for instance, a GPS, Bluetooth, and the like, can be added and, by extension, application to an antenna of a portable radio, such as a cellular phone and a PDA.

The invention claimed is:

1. An antenna element comprising:

a first antenna element in which at least three surfaces of a substantial rectangular parallelepiped are defined by: a substantially rectangular first conductor plate arranged at a predetermined space apart from a ground plate; a substantially rectangular second conductor plate sharing one widthwise side of the first conductor plate and arranged at an angle of about 90° with respect to the first conductor plate; a substantially rectangular third conductor plate sharing another widthwise side of the second conductor plate opposing the widthwise side shared by the first conductor plate and the second conductor plate, and arranged at an angle of about 90° with respect to the second conductor plate; and an electric feeding conductor connected to the first conductor plate and a corner of the ground plate and configured to feed electric power from a corner of the ground plate to the first conductor plate; and a second antenna element in which at least three surfaces of a substantial rectangular parallelepiped are defined by: a substantially rectangular fourth conductor plate connected by way of a resonance circuit to the first antenna element at a portion thereof apart from a feeding point of the first antenna element; a substantially rectangular fifth conductor plate sharing one side of the fourth conductor plate and arranged at an angle of about 90° with respect to the fourth conductor plate; and a substantially rectangular sixth conductor plate sharing another side of the fifth conductor plate opposing the side of the fifth conductor plate shared by the fourth conductor plate, and arranged at an angle of about 90° with respect to the fourth conductor plate.

2. An antenna element comprising:

a first antenna element in which at least three surfaces of a substantial rectangular parallelepiped are defined by: a substantially rectangular first conductor plate arranged at a predetermined space apart from a ground plate; a substantially rectangular second conductor plate sharing one widthwise side of the first conductor plate and arranged at an angle of about 90° with respect to the first conductor plate; and a substantially rectangular third conductor plate sharing another widthwise side of the second conductor plate opposing the widthwise side shared by the first conductor plate and the second conductor plate, and arranged at an angle of about 90° with respect to the second conductor plate; and an electric feeding conductor connected to the first conductor plate and a corner of the ground plate and configured to feed electric power from a corner of the ground plate to the first conductor plate; and a third antenna element including a substantially rectangular seventh conductor plate that is electrically connected to the electric feeding conductor near the location where electric power is fed from the ground plate to the first conductor plate and that has the largest side whose size is about λ/4 of a specific frequency.

3. The portable radio of claim 2, wherein the third antenna element further comprises a substantially rectangular first connection conductor plate and a substantially rectangular second connection conductor plate, one end of the first connection conductor plate electrically connected to the electric feeding conductor and the other end of the first connection conductor plate electrically connected to the second connection conductor plate, the second conductor plate including two short sides, one short side electrically connected to a short side of the seventh conductor plate.

4. A portable radio including a first housing for accommodating a ground plate of the portable radio, a second housing equipped with an antenna element, and a hinge which connects the first housing to the second housing and which holds the second housing rotatably with respect to the first housing, wherein the antenna element provided in the second housing comprises:

a first antenna element placed in proximity to the hinge and having a shape in which the first conductor plate, the second conductor plate, and the third conductor plate are arranged so as to define at least three surfaces of a substantial rectangular parallelepiped;

an electric feeding conductor connected to the first conductor plate and a corner of the ground plate and configured to feed electric power from a corner of the ground plate to the first conductor plate; and a second antenna element having a shape in which a fourth conductor plate, a fifth conductor plate, and a sixth conductor plate are arranged so as to define at least three surfaces of a substantial rectangular parallelepiped, the fourth conductor plate being connected by way of a resonance circuit to the first antenna element at a location apart from a location where the electric feeding conductor is connected to the first antenna element.

5. A portable radio including a first housing for accommodating a ground plate of the portable radio, a second housing equipped with an antenna element, and a hinge which connects the first housing to the second housing and which holds the second housing rotatably with respect to the first housing, the portable radio comprising:

a first antenna element having a shape in which the first conductor plate, the second conductor plate, and the third conductor plate are arranged so as to define at least three surfaces of a substantial rectangular parallelepiped;

an electric feeding conductor connected to the first conductor plate and a corner of the ground plate and configured to feed electric power from a corner of the ground plate to the first conductor plate; and a third antenna element including a substantially rectangular seventh conductor plate that is electrically connected to the electric feeding conductor near the location where electric power is fed from the ground plate to the first conductor plate and that has the largest side whose size is about λ/4 of a specific frequency.

* * * * *